US005797497A

United States Patent [19]

Edwards

[11] Patent Number: 5,797,497

[45] Date of Patent: Aug. 25, 1998

[54] FLATWARE TRAP FOR WASTE CONTAINERS

[76] Inventor: Richard E. Edwards, 1750 Ocean Ave., Long Beach, Calif. 90808

[21] Appl. No.: 603,910

[22] Filed: Feb. 22, 1996

[51] Int. Cl.[6] ..... B07C 5/344

[52] U.S. Cl. ..... 209/570; 209/703; 209/926

[58] Field of Search ..... 209/568, 570, 209/571, 567, 702, 703, 910, 911, 926, 930

[56] References Cited

U.S. PATENT DOCUMENTS

| | | | |
|---|---|---|---|
| 1,138,889 | 5/1915 | Rand . | |
| 1,930,108 | 10/1933 | Reeder | 209/228 |
| 2,587,158 | 2/1952 | Hofberg | 209/81 |
| 2,698,450 | 1/1955 | Mack | 15/121.1 |
| 2,869,795 | 1/1959 | Higer | 241/301 |
| 3,157,904 | 11/1964 | Flodell | 15/511 |
| 3,283,899 | 11/1966 | Vedvik et al. | 209/111.8 |
| 3,301,397 | 1/1967 | Stutz | 209/73 |
| 3,394,806 | 7/1968 | Vaillette | 209/111.9 |
| 3,877,577 | 4/1975 | Richard | 209/73 |
| 3,938,533 | 2/1976 | Richard | 134/63 |
| 4,171,262 | 10/1979 | Lattmann et al. | 209/555 |
| 4,203,537 | 5/1980 | McAlister | 222/570 |
| 4,279,744 | 7/1981 | Antonwitsch | 209/214 |
| 4,367,138 | 1/1983 | Kustas | 209/224 |
| 4,480,753 | 11/1984 | Thomas et al. | 209/546 |
| 4,494,657 | 1/1985 | Oldenkamp | 209/636 |
| 4,632,253 | 12/1986 | Stromgren et al. | 209/570 |
| 4,706,818 | 11/1987 | Zutell et al. | 209/636 |
| 4,782,970 | 11/1988 | Edwards | 220/1 R |
| 5,538,143 | 7/1996 | Pettersson | 209/926 X |

FOREIGN PATENT DOCUMENTS

| | | |
|---|---|---|
| 2547474 | 5/1977 | Germany . |
| 2610272 | 9/1977 | Germany . |

*Primary Examiner*—Boris Milef

*Attorney, Agent, or Firm*—Stetina Brunda Garred & Brucker

[57] ABSTRACT

A device for trapping flatware in food waste prior to entry into a trash container includes a housing positioned onto the trash container having a downwardly sloping chute, an electronic metal detector disposed in the housing, and a mechanically-operated pivoting door that guards the lower opening of the chute. A spring-loaded mechanical linkage closes the door upon being released by an actuator, that is signaled by the metal detector as to when flatware is present. The use of a spring-loaded mechanism to operate the pivoting door minimizes power requirements and is lightweight, as compared to a drive motor or other machines of the prior art.

11 Claims, 4 Drawing Sheets

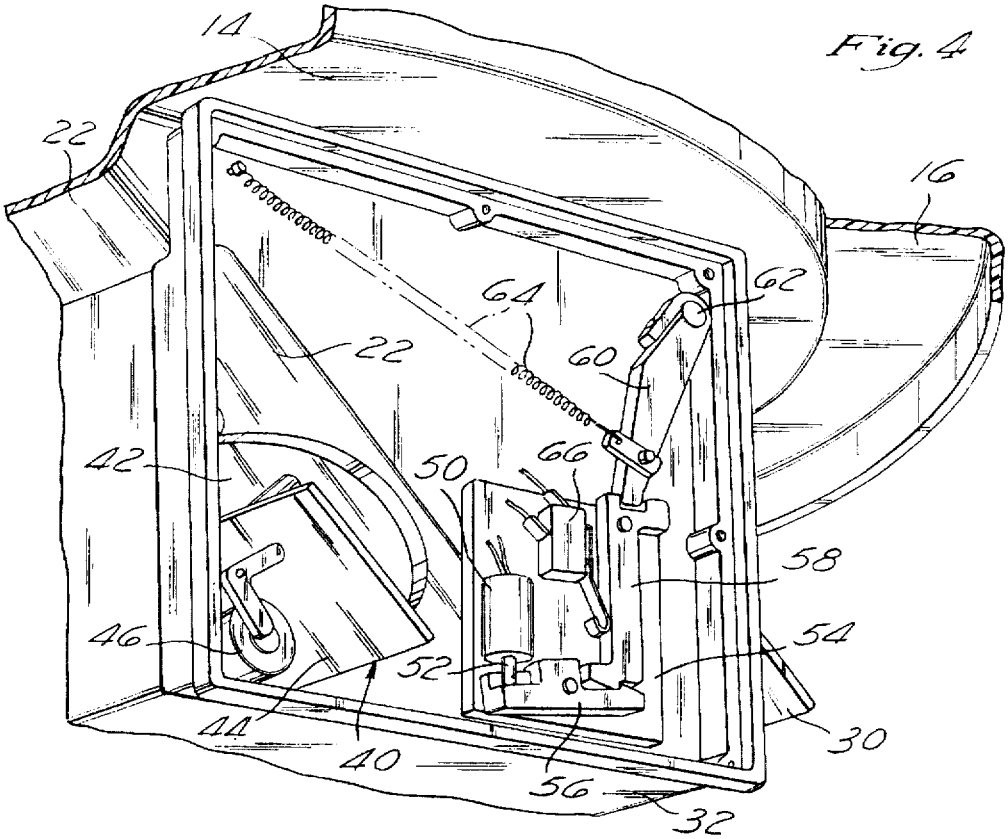
Fig. 4
Fig. 5
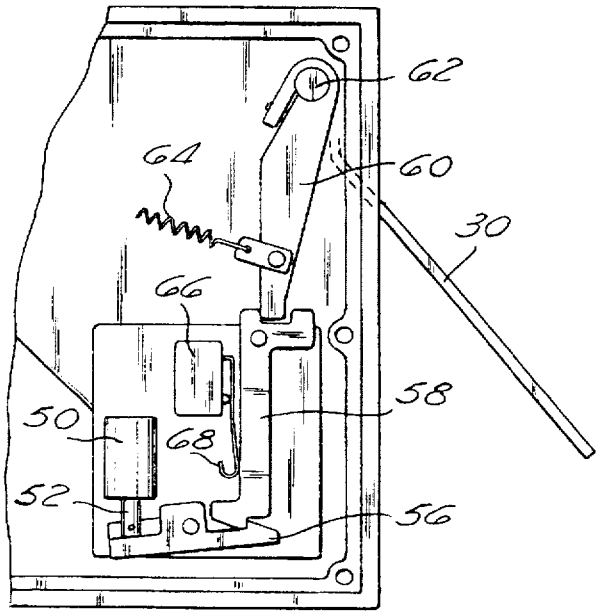
Fig. 6
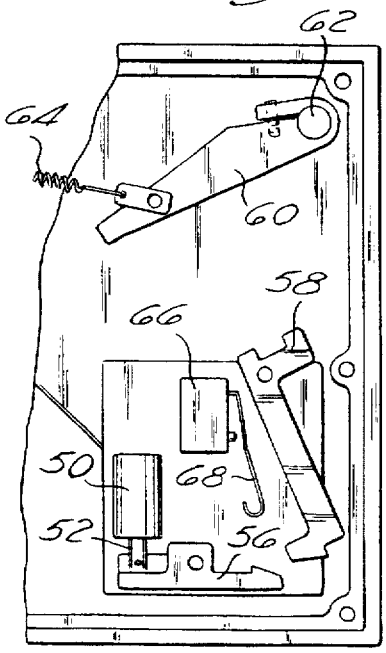

FLATWARE TRAP FOR WASTE CONTAINERS

FIELD OF THE INVENTION

The present invention relates generally to devices for trapping flatware commingled in food waste, prior to entry into a trash container. More particularly, the present invention relates to such devices formed as a chute placed at the entrance of the trash container, the device further having an electronic metal detector that senses the presence of flatware and signals a mechanically-operated door to close the chute.

BACKGROUND OF THE INVENTION

Apparatus to prevent the loss of flatware into conventional trash containers or other tableware processing systems (e.g., a conveyor belt system as commonly seen in cafeterias) have been proposed, with the promise of a fast payback through reduced purchases of replacement flatware. In a recent survey, losses of individual pieces of flatware generally ranged between 4 and 12 pieces per shift, due to inadvertent or careless disposal of flatware with dish and pot scrapings. Typical metal tableware, such as knives, forks, and spoons, have an average cost of $4.50 per dozen pieces, meaning that annual losses due to accidentally discarded flatware may easily total between $1,000 to $3,000. A conscientious employee who accidentally discards flatware may try to retrieve the lost articles, but this involves the employee blindly placing his or her hands and arms into a deep trash can, an undertaking that is unsafe and unsanitary.

Early attempts to deal with the problem of preventing inadvertent discarding of tableware commingled with food trash brought devices configured as lids to fit onto standard trash receptacles, such devices employing magnets in the path of food trash to attract and stop the flow of ferrous metal tableware. Unfortunately, those devices tended to obstruct the flow of trash into the receptacle, and oftentimes the tableware was not reliably intercepted. Additionally, those devices with magnets exposed to trash tended to retain remnants of the trash and require frequent, cleaning to maintain the effectiveness of the device and prevent bacterial growth on the device. Applicant's previous U.S. Pat. No. 4,782,970 (issued Nov. 8, 1988) for a MAGNETIC TRASH CONTAINER LID, the contents of which are incorporated by reference, disclosed a device having a sealed housing with a flat, downward-sloping surface under which magnets were placed, to retain magnetically attractable tableware to that surface without impeding the flow of trash into the trash container. Applicant's previous invention offered the important advantages of increasing the effectiveness of magnetic devices to keep tableware out of the trash, and additionally improving the hygienic conditions associated such devices. Applicant found that approximately 75% of the food service industry use 400 Series Stainless Steel Flatware, which is sufficiently ferrous and magnetic to be easily "grabbed" by the magnetic trash container lid. Applicant also found, however, that a portion of the food service business uses stainless steel of the 200 and 300 Series (commonly referred to as 18/8 and 18/10), which contains little ferrous metal and is not sufficiently magnetic to be reliably "grabbed".

Other prior art attempts to sort tableware from a stream of waste material include devices which detect metallic flatware, and temporarily stop the flow of waste and/or divert waste, so that the flatware may be retrieved. For example, Stromgren U.S. Pat. No. 4,622,253 (issued Dec. 30, 1986) for an APPARATUS FOR SEPARATING CUTLERY FROM RESTAURANT WASTE disclosed a hopper and an inductive-type probe that controls a drive member for pivoting a flap, that temporarily closes off the opening into the waste container. The drive means is an electric motor having a rotating shaft, to rapidly turn the pivoting flap from an open to closed position. This type of device offers the potential advantage of being operable and functional for all types of stainless steel flatware generally used in the food service industry, as the inductive type metal detector will sense any conductor. This type of device, however, requires significant amounts of power to operate the electric drive means, and additionally to operate the metal detector.

Although the MAGNETIC TRASH CONTAINER LID APPARATUS FOR SEPARATING CUTLERY FROM RESTAURANT WASTE and other related prior art devices have proven generally suitable for their intended purposes, the inherent deficiencies mentioned above detract from their overall desirability in the marketplace. In view of these shortcomings of the prior art, it is the object of the present invention to provide a device for trapping metallic objects which operates efficiently so as to minimize power requirements. It is further desirable to provide a device of improved effectiveness that reliably senses the presence of flatware and quickly responds so as to prevent its passage into the waste container. Additionally, it is the object of the present invention to provide a device that is effective in preventing the loss of all types of stainless steel flatware used in the food service industry. It is also the object of the present invention to provide a device that prevents bacterial penetration, is easy to clean, and may be used with complete safety. Finally, it is desirable to provide a device that is simple and inexpensive to manufacture, requires no maintenance, and is compact and lightweight.

SUMMARY OF THE INVENTION

The present invention specifically addresses and alleviates the above-mentioned deficiencies associated with the prior art. The present invention generally comprises a device for trapping flatware commingled in food waste, prior to entry into a conventional trash container. More particularly, in a preferred embodiment of the invention the device includes a housing that is fitted to the opening of the trash container, the housing having a downwardly sloping surface that forms a chute for passage of food waste. At the lower opening of the chute is a door that may be closed to obstruct the chute. It is a spring-loaded mechanical linkage connected to the door that closes the door when flatware is detected in the chute. A metal detector disposed within the housing sends a signal to an actuator, such as a solenoid, that causes the mechanical linkage to move thereby releasing the spring to close the door. It is the spring in the mechanical linkage that provides the stored energy to rapidly close the door and obstruct the chute opening. The spring-loaded mechanical linkage will not wear out, requires no maintenance, and should not break if the device is dropped, an event that is likely to happen in food service when personnel remove the device to empty the trash container. The device may further include an electric switch that cuts off power to the metal detector when the door is closed, offering added power savings.

In the preferred embodiment, the housing has an upper surface that forms a generally horizontal lid for the trash container, and the chute projects inside the trash container. This makes the device compact in that no height is added to the trash container, such that additional volume above the trash container is not required to use the device. The device together with the trash container still fits beneath an opening in a counter or work table, a preferred location in many restaurant kitchens.

Additionally, the preferred embodiment of the invention further includes a housing that is completely sealed to prevent moisture and bacteria penetration, and the mechanical linkage is totally enclosed in the housing to provide safety. The device is simple to clean by wiping the flat exposed areas of the housing with a damp cloth. Additionally, restaurant personnel need not risk injury from contacting moving parts of the device in disposing of food waste into the trash can as utensils trapped in the chute may be easily retrieved.

The configuration of the chute advantageously has a downwardly sloping surface that plate and pot scrapings and other waste material contact on route into the trash container. This gradually pitched surface prevents the food trash from passing too quickly, holding the food waste and commingled flatware in the chute for a sufficiently long period for flatware to be detected, such that the door closes prior to passage of the flatware into the trash container.

Lastly, the device preferably includes an inductive-type metal detector, where electricity is used to create a magnetic field. When a piece of metal passes through the magnetic field, the field produces electric eddy currents that circulate in the metal. The eddy currents in turn produce their own magnetic field, and a metal detector detects this field. The metal detector preferably has transmit and receive coils which overlap, such that each induces a current in the other. Normally the two currents cancel out, but the magnetic field of a metal object distorts this balance and a low current appears in the receiver coil. Low current below a certain threshold valve indicates a finding of flatware, and an electric signal is produced that goes to the actuator of the trapping device. Alternatively, single-coil detectors may be used, where a brief pulse of current fed to the coil produces a magnetic field, and if metal is present the eddy currents induced in the metal generate a magnetic field that in turn induces an opposite current in the now inactive coil. Any flatware capable of transmitting electricity may be detected by this type of inductive metal detector, and the flatware trapped prior to entry into the trash receptacle.

These, as well as other advantages of the present invention will become more apparent from the following description and drawings. It is understood that changes in the specific structure shown and described may be made within the scope of the claims without departing from the spirit of the invention.

BRIEF DESCRIPTION OF THE DRAWINGS

FIG. 4 is a reverse perspective view of the spring-loaded mechanical linkage, metal detector, and actuator of the device, those components disposed inside the housing;

FIG. 5 is a side view of the spring-loaded mechanical linkage connected to the pivoting door, the pivoting door shown in the open position;

FIG. 6 is a side view of the spring-loaded mechanical linkage shown in the released position, the pivoting door (not shown) being closed;

DETAILED DESCRIPTION OF THE PREFERRED EMBODIMENT

The detailed discussion set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

Figure 1:
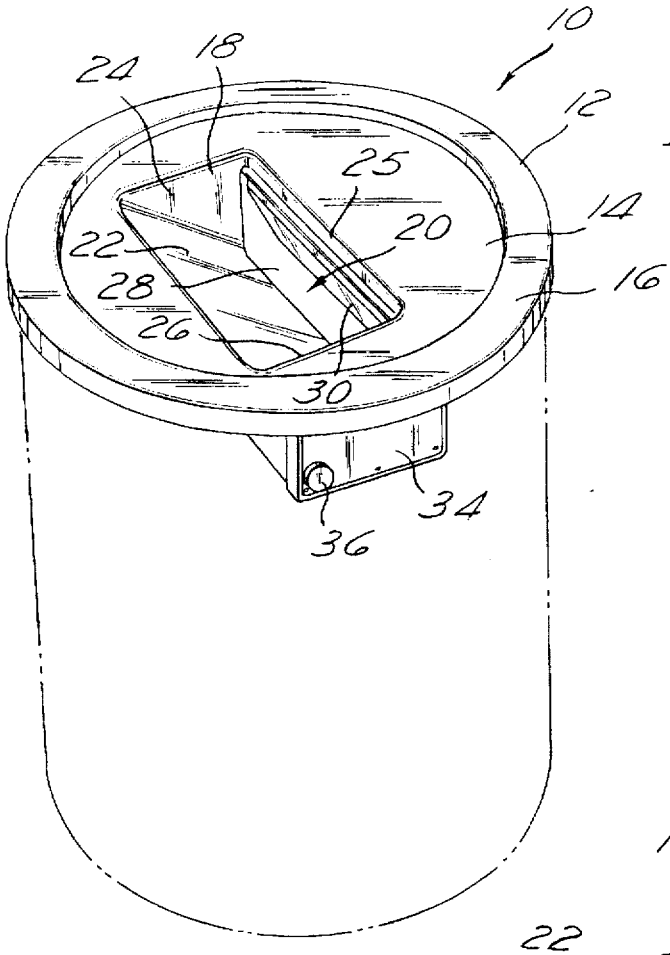
FIG. 1 is a perspective view show a flatware trap device in accordance with the preferred embodiment of the present invention, as placed on a conventional trash container.

The flatware trap device for a conventional trash container of the present invention is illustrated in FIGS. 1–8 which depict a presently preferred embodiment of the invention. Referring first to FIG. 1, the flatware trap device 10 is shown placed in a standard 32 or 44 gallon trash container. A jumbo version of the flatware trap 10 is available to fit larger 55 gallon containers, and a junior version is available to fit smaller 18 and 23 gallon rectangular containers. The housing 12 of the device 10 has a planar upper surface 14, that as installed is at approximately the same height as the upper rim of the trash container. The housing 12 further has a raised shoulder or lip 16 that fits over the annular rim of the trash container. The housing 12 is generally fabricated of a molded plastic material, offering the advantages of low cost and light weight. The total weight of the device, including the housing and other components to be described below, is less than 25 pounds, this low weight being important as the device must be removed and replaced each time the trash container is emptied.

The upper surface 14 of the housing 12 has an upper opening 18 that defines the upper end of a chute 20, through which food waste passes into the trash container. Additionally to form the chute 20, the housing 12 has a downwardly sloping surface 22, and three substantially vertical sides 24, 25, and 26. The downwardly sloping surface 22 and three vertical sides 24, 25, and 26 extend to a lower opening 28 in the housing 12, to form the lower end of the chute 20. A pivoting door 30 (also see FIG. 3) is hinged along the upper edge of the lower opening 28 of the housing 12, the pivoting door 30 normally in an open position so as to not to obstruct the chute 20.

Figure 2:
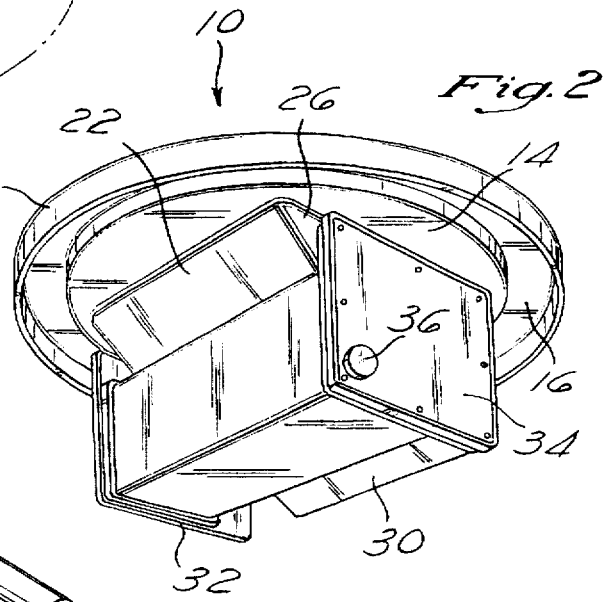
FIG. 2 is a reverse perspective view of the flatware trap device, showing the completely sealed housing.
Figure 3:
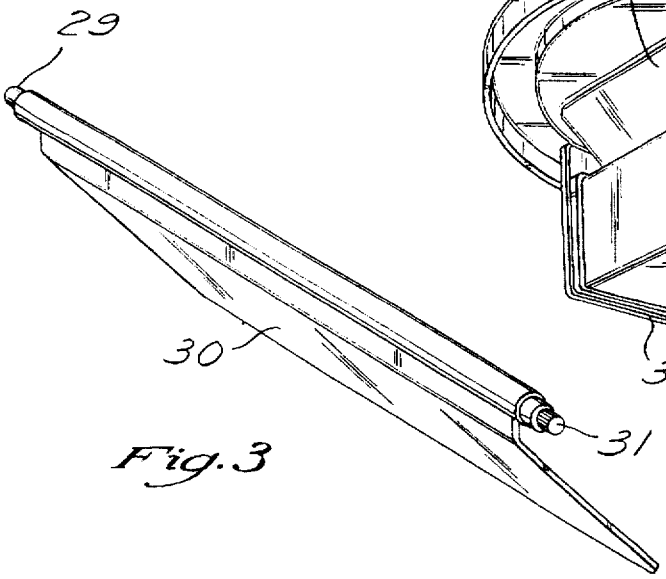
FIG. 3 is a perspective view of the pivoting door of the device, the door shown in the open position.

Also referring to FIG. 2, the remaining underside features of the housing 12 may be described. Beneath the upper surface 14 of the housing 12, and surrounding the chute 20, is an equipment box 32 that holds the components which provide the metal detecting and pivoting door functions of the device 10 which trap densely metallic objects. The equipment box 32 includes an access panel 34 held on by eight removable fasteners, and within that access panel 34 is a removable battery cover 36 such that batteries 46 stored inside the equipment box 32 may be removed and replaced.

Referring to FIG. 4, the electrical components of the device 10 contained in the equipment box 32 may be described. The device 10 includes a metal detector 40 having a detector head 42 mounted against the underside of the downwardly sloping surface 22 of the housing 12. Electrically connected to the detector head 42 is a printed circuit board 44 that processes signals received from the detector head 42, and when appropriate sends a signal to an actuator to trip the pivoting door 30 thereby trapping flatware in the chute 20. The detector 42 and circuit board 44 are powered by eight size "C" cell batteries 46, stored end-to-end in the equipment box 32.

Figure 9:
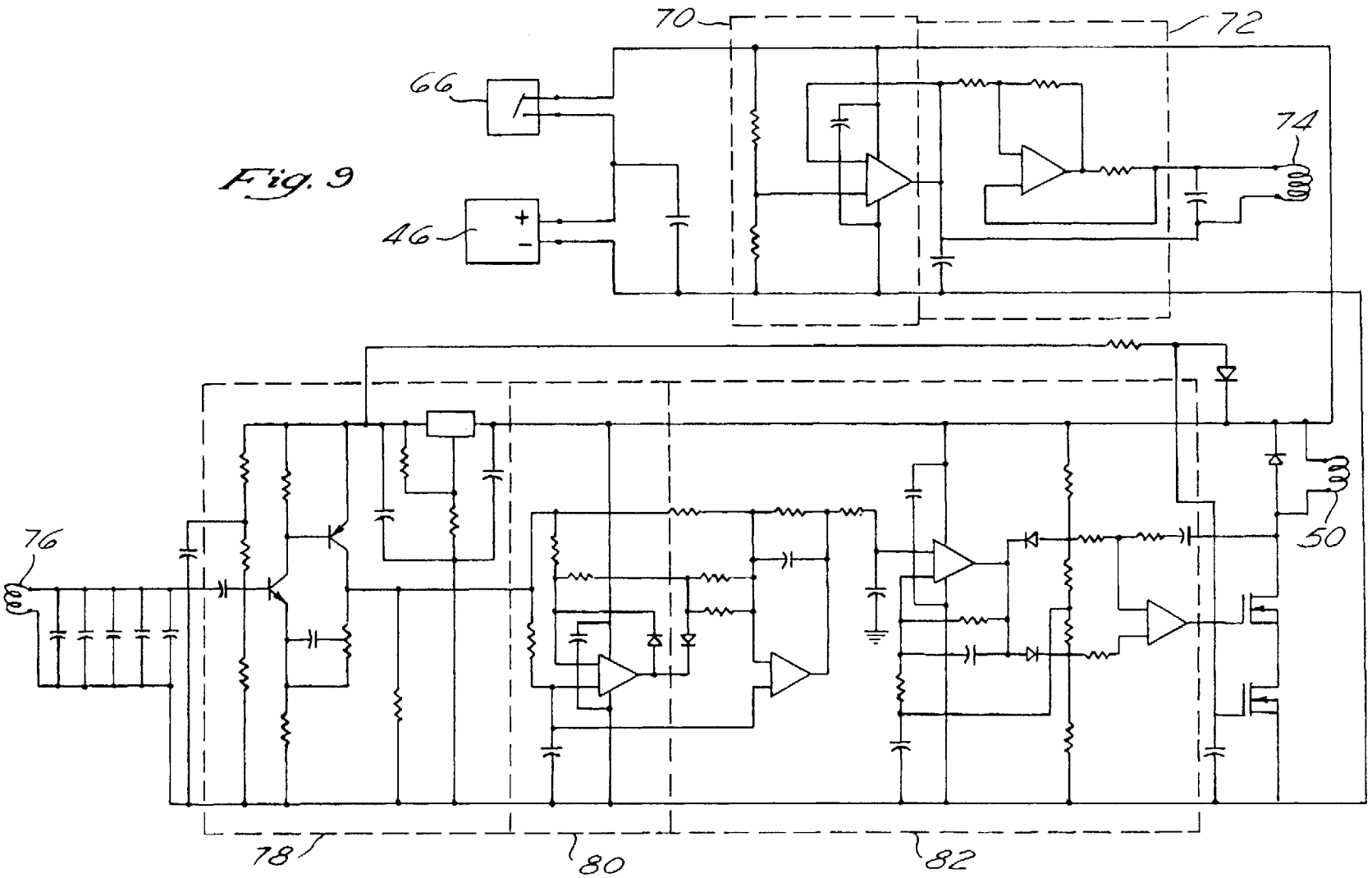
FIG. 9 is a detailed wiring diagram showing the connections of the electrical components of the device.

In reference to the wiring diagram of FIG. 9, the details of the electrical circuitry of the flatware trap device 10 may be described. The electrical components are powered by the eight size "C" cell batteries 46 mentioned above. A microswitch 66 is opened to cut off power to the electrical components of the device 10, when the pivoting door 30 is closed (see FIG. 6) and a spring contact 68 is not depressed. When the microswitch 66 is closed current flows to an oscillator 70 creating an output signal that passes through an amplifier 72. A capacitor together with a transmit antenna 74 form a tuned circuit at frequency $F_1$. That frequency is received through a receive antenna 76 that together with several capacitors form a second tuned circuit at frequency $F_2$. The received signal passes through an amplifier 78, and then into a comparator 80. In the comparator 80 there is a comparison with known reference values, to separate an indication of flatware from noise level signals. If the comparator 80 evaluates that flatware is present, a signal is sent that passes through an amplifier 82, and to the actuator coil of a conventional solenoid 50.

Now additionally referring to FIGS. 5 and 6, the electromechanical and mechanical components of the device 10 which comprise a mechanical linkage contained in the equipment box 32 may be described. Several of these components are mounted to an aluminum mounting plate 54, that is attached to the equipment box 32. The actuator is a conventional solenoid 50 having a coil, a spring, and an iron plunger 52 contained therein. When current flows through the coil contained in the solenoid 50 this causes upward vertical movement of the iron plunger 52, and when the current flow through the coil is cut off the spring inside the conventional solenoid 50 causes the iron plunger 52 to return to the down position. The solenoid pivot arm 56 is pivotally connected in its middle portion to the mounting plate 54, and is pivotally connected at the left end to the iron plunger 52 of the solenoid 50. At the right end the solenoid pivot arm 56 is connected through complimentary teeth to the lower end of the latch lever 58, that is pivotally connected at its upper end to the mounting plate 54. Also attached to the mounting plate 54 is the conventional microswitch 66 having the spring contact 68 that may be depressed by the latch lever 58 (FIG. 5), the function of which was discussed above.

Continuing to refer to FIGS. 4–6, the mechanical components which comprise the remainder of the mechanical linkage that drives the pivoting door 30 may be described. The upper end of the latch lever 58 has a slot that engages the lower end of the door arm 60, that is pivotally connected at its upper end through use of a pivot rod extender 62. The pivot rod extender 62 is fixedly attached to the door pivot shaft end 31 (see FIG. 3), that is fixedly attached to the door pivot rod 29. The door pivot rod 29 is rotatably connected to the housing 12, and fixedly connected to the pivoting door 30. Twelve ⅛-inch diameter fasteners 63 (see FIG. 7) secure the door pivot rod 29 to the pivoting door 30. Also pivotally connected to the lower portion of the door arm 60 is one end of a tension spring 64, with the other end connected on the opposite side of the equipment box 32.

Finally, the operation, function, and use of the flatware trap device 10 for trash containers of the preferred embodiment of the present invention may be described. The first step in utilizing the flatware trap device 10 would be to remove the battery cover 36, and insert eight size "C" cell batteries 46 into in-line storage, and replace the battery cover 36 back onto the equipment box 32. Next, the device 10 is placed onto the upper rim of the conventional trash container as shown in FIG. 1. The pivoting door 30 is manually pushed to the open position, that causes a counterclockwise rotation of the pivot shaft end 31 and the pivot rod extender 62. This causes a counterclockwise rotation of the door arm 60 about its upper end, which lengthens the spring 64 creating a stored tensile force. The lower end of the door arm 60 is rotated clockwise until it engages the upper, slotted end of the latch lever 58. This causes a clockwise rotation of the latch lever 58 about its upper end, moving the middle portion of the latch lever 58 to depress the spring contact 68, and moving the teeth of the lower portion of the latch lever 58 and the right end of the pivot arm 56 to engage. The engaging of the corresponding teeth of the solenoid pivot arm 56 and the latch lever 58 locks the spring-loaded mechanical linkage. The pressing of the spring contact 68 is additionally operative to close the microswitch 66, allowing current to flow from the batteries 46 to the detector head 42, associated electronics on the printed circuit board 44, and the solenoid 50. The flatware device 10 is now installed and operating.

Figure 7:
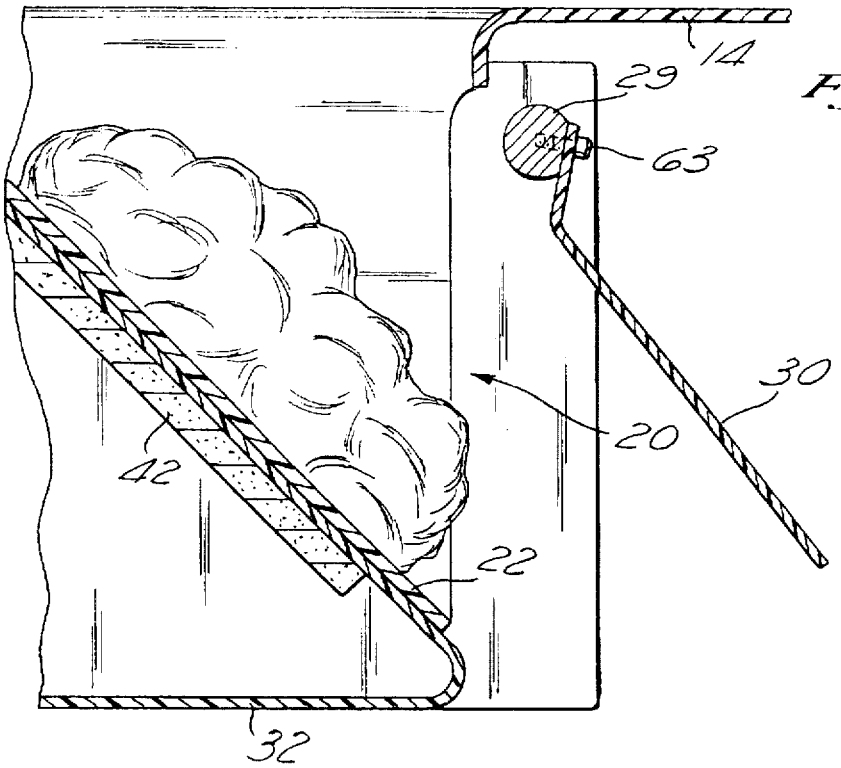
FIG. 7 is a side view showing food waste disposed on the housing downwardly sloping surface, the pivoting door in the open position.
Figure 8:
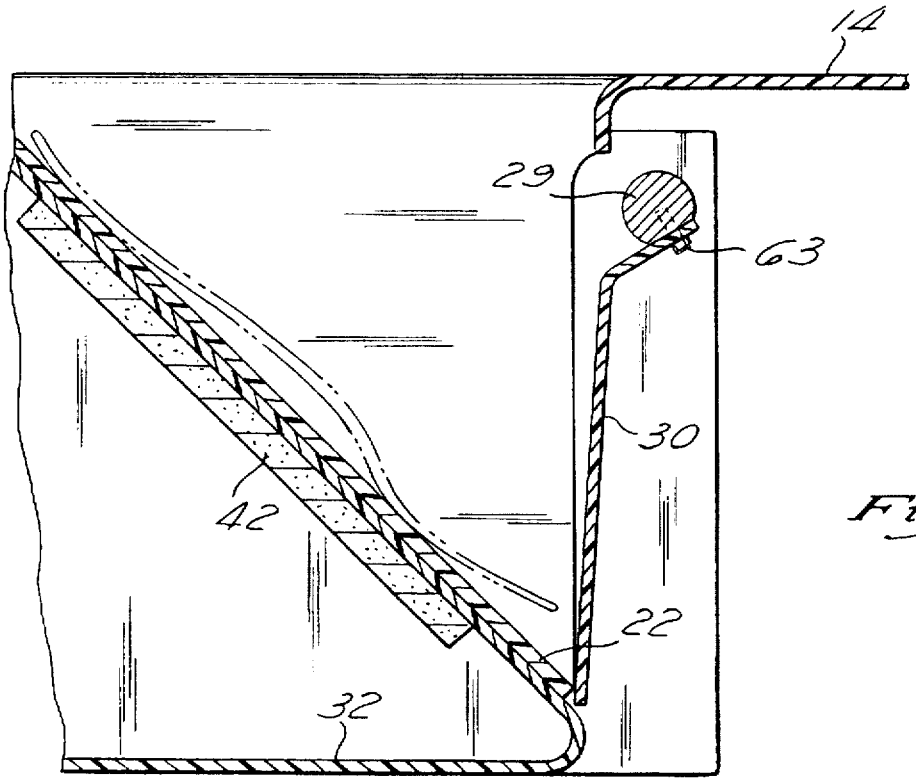
FIG. 8 is a side view showing flatware disposed on the housing downwardly sloping surface, the pivoting door in the closed position.

Also referring to FIGS. 7 and 8, the process of passing trash through the chute 20 of the device 10, and the event of detecting flatware may be described. Food waste including plate and pot scrapings and the like is deposited onto the downwardly sloping surface 22 of the housing 12. The metal detector head 42 mounted underneath the downwardly sloping surface 22 senses whether there is an interference in the magnetic field caused by the presence of flatware. If such flatware is present, the coil in the solenoid 50 is energized causing the iron plunger 52 to move vertically upward. This causes the solenoid pivot arm 56 to rotate clockwise, thereby releasing the latch lever 58 allowing it to rotate counterclockwise. This releases the door arm 60 allowing it to rotate clockwise as pulled by the stored energy in the tension spring 64. The rotation of the door arm 60 together with the pivot rod extender 62, pivot shaft end 31, and pivot rod 29, cause the pivoting door 30 to rapidly rotate in a clockwise direction. The clockwise rotation of the pivoting door 30 continues until the lower end of the pivoting door 30 reaches the closed position. The pivoting door 30 is closed prior to the flatware sliding down the downwardly sloping surface 22, such that the flatware is prevented from passing through the chute 20 and entering the trash container. The restaurant service worker may retrieve the flatware from the downwardly sloping surface 22 of the housing 12, without the need to place his or her hands or arms into the trash container. The pivoting door 30 in the closed position has also released the spring contact 68 of the microswitch 60, such that no power is being drawn while the pivoting door 30 is closed. Once the flatware is removed, the restaurant service worker may push the pivoting door 30 open, allowing any food waste remaining on the downwardly sloping surface 22 of the housing 12 to pass into the trash container. The opening of the pivoting door 30 also closes the microswitch 66, reactivating the metal detector and associated electronics of the device 10.

It is understood that the flatware trap device for trash containers described herein and shown in the drawings represent only a presently preferred embodiment of the invention. Indeed, various modifications and additions may be made to the embodiment shown without departing from the spirit and scope of the invention. These and other modifications and additions may be obvious to those skilled in the art and may be implemented to adapt the present invention for use in a wide variety of different applications.

What is claimed is:

1. A device for trapping densely metallic objects present in food waste prior to entry into a trash container, the device comprising:

a housing adapted to be supported proximate the entrance of the trash container;

the housing having a downwardly sloping surface to a lower opening at a lower end, to form a chute for passing of the food waste into the trash container;

a door disposed proximate the lower opening, the door movable between an open position and a closed position obstructing the lower opening;

a spring-loaded mechanical linkage connected to the door, operative upon release to move the door from the open to the closed position such that the door remains in the closed position until manually opened;

a metal detector disposed proximate the housing sloping surface and physically isolated from contact with the passing food waste, the detector operative to detect dense metal objects and transmit a signal upon detection;

an actuator connected to the mechanical linkage and in communication with the metal detector, operative upon receiving the transmitted signal from the detector to cause the mechanical linkage to be released.

2. The device of claim 1 wherein:

the housing has an upper surface that forms a generally horizontal lid for the trash container; and the housing upper surface has an upper opening that defines an upper end of the chute, the chute extending into the trash container.

3. The device of claim 1 wherein:

the chute is of a generally rectangular-shaped horizontal cross-section, having the downwardly sloping surface and three substantially vertical sides.

4. The device of claim 1 wherein:

the door is pivotally connected to the housing proximate the lower opening, the door pivots between the open and closed positions.

5. The device of claim 1 further including:

a power source electrically connected to the metal detector; and a switch operative to cut off power to the metal detector when the door is in the closed position.

6. The device of claim 1 wherein:

the metal detector is an inductive metal detector, having a pair of overlapping coils which sense a magnetic field therebetween.

7. The device of claim 1 wherein:

the actuator is a solenoid, that when energized moves the mechanical linkage causing its release.

8. The device of claim 1 wherein:

the housing is sealed, to prevent bacteria and moisture penetrating into the housing.

9. The device of claim 1 wherein:

the mechanical linkage and actuator are disposed inside the housing, to prevent inadvertent contact with moving parts of the mechanical linkage and the actuator.

10. A device for trapping densely metallic objects present in food waste prior to entry into a trash container, the device comprising:

a housing having an upper surface that forms a generally horizontal lid for the trash container;

the housing upper surface having an upper opening that defines an upper end of a chute, the chute having a downwardly sloping surface to a lower opening for passing of the food waste into the trash container;

a door disposed proximate the lower opening, the door movable between an open position and a closed position obstructing the lower opening;

a metal detector disposed proximate the chute sloping surface and physically isolated from contact with the passing food waste material, the detector operative to detect dense metal objects and transmit a signal upon detection;

a machine connected to the door and in communication with the metal detector, the machine operative to move the door from the open position to the closed position upon receiving the transmitted signal from the metal detector such that the door remains in the closed position until manually opened.

11. A device for trapping densely metallic objects present in food waste prior to entry into a trash container, the device comprising:

a housing adapted to be supported proximate the entrance of the trash container;

the housing having a downwardly sloping surface to a lower opening at a lower end, to form a chute for passing of the food waste material into the trash container;

a door disposed proximate the lower opening, the door movable between an open position and a closed position obstructing the lower opening;

a metal detector disposed proximate the downwardly sloping surface and physically isolated from contact with the passing food waste, the detector operative to detect dense metal objects and transmit a signal upon detection;

a machine connected to the door and in communication with the metal detector, the machine operative to move the door from the open position to the closed position upon receiving the transmitted signal from the metal detector such that the door remains in the closed position until manually opened;

a power source electrically connected to the metal detector; and a switch operative to cut off power to the metal detector when the door is in the closed position.

* * * * *